US012624411B2

(12) United States Patent
Kim et al.

(10) Patent No.: US 12,624,411 B2
(45) Date of Patent: May 12, 2026

(54) HIGH-STRENGTH STEEL SHEET HAVING EXCELLENT FORMABILITY AND METHOD FOR MANUFACTURING THEREOF

(71) Applicant: POSCO CO., LTD, Pohang-si (KR)

(72) Inventors: Sung-Kyu Kim, Gwangyang-si (KR); Jun-Ho Park, Gwangyang-si (KR); Chang-Hyo Seo, Gwangyang-si (KR); Eul-Yong Choi, Gwangyang-si (KR); Sang-Ho Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 579 days.

(21) Appl. No.: 18/010,041

(22) PCT Filed: Jun. 16, 2021

(86) PCT No.: PCT/KR2021/007573
§ 371 (c)(1),
(2) Date: Dec. 13, 2022

(87) PCT Pub. No.: WO2021/256862
PCT Pub. Date: Dec. 23, 2021

(65) Prior Publication Data

US 2023/0272500 A1 Aug. 31, 2023

(30) Foreign Application Priority Data

Jun. 17, 2020 (KR) ..... 10-2020-0073811

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS

2003/0047257 A1 3/2003 Kami et al.
2011/0030854 A1 2/2011 Matsuda et al.
(Continued)

FOREIGN PATENT DOCUMENTS

CN 108884536 A 11/2018
EP 1022347 7/2000
(Continued)

OTHER PUBLICATIONS

Chinese Office Action—Chinese Application No. 202180043856.5 issued on Feb. 21, 2024, citing US 2014/0205855, US 2016/0355903, US 2003/0047257, JP 2000-026921, US 2011/0030854, and CN 108884536.
(Continued)

*Primary Examiner* — Anthony M Liang
(74) *Attorney, Agent, or Firm* — CANTOR COLBURN LLP

(57) ABSTRACT

Provided is a high-strength steel sheet suitable for automobile structural members, etc., and a method for manufacturing same, wherein the high-strength steel sheet has a low yield ratio and high strength and has excellent formability through improvement of ductility that may prevent processing defects such as cracks, wrinkles, or the like, during press forming.

4 Claims, 4 Drawing Sheets

(51) Int. Cl.

| | |
|---|---|
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |

(52) U.S. Cl.
CPC ..... *C21D 8/0263* (2013.01); *C21D 8/0273* (2013.01); *C22C 38/002* (2013.01); *C22C 38/02* (2013.01); *C22C 38/04* (2013.01); *C22C 38/12* (2013.01); *C22C 38/14* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2014/0205855 | A1 | 7/2014 | Kawata et al. |
| 2016/0355903 | A1 | 12/2016 | Kwak et al. |
| 2017/0137906 | A1 | 5/2017 | Fan et al. |
| 2018/0002771 | A1 | 1/2018 | Han et al. |
| 2019/0071745 | A1 | 3/2019 | Lee et al. |
| 2019/0337267 | A1 | 11/2019 | Ahn et al. |
| 2020/0017933 | A1 | 1/2020 | Honda et al. |

FOREIGN PATENT DOCUMENTS

| | | | |
|---|---|---|---|
| EP | 3730635 | | 10/2020 |
| JP | H04289120 | | 10/1992 |
| JP | 2000026921 | | 1/2000 |
| JP | 2005264176 | | 9/2005 |
| JP | 2006002186 | A | 1/2006 |
| JP | 2008214645 | A | 9/2008 |
| JP | 2008255441 | A | 10/2008 |
| JP | 2009019258 | A | 1/2009 |
| JP | 2010059452 | A | 3/2010 |
| JP | 2017504716 | A | 2/2017 |
| KR | 20100101697 | | 9/2010 |
| KR | 20130002209 | | 1/2013 |
| KR | 20140041838 | | 4/2014 |
| KR | 20150073844 | | 7/2015 |
| KR | 20150075311 | | 7/2015 |
| KR | 20160078570 | A | 7/2016 |
| KR | 20190075589 | | 7/2019 |
| KR | 20190076258 | | 7/2019 |
| KR | 20190107693 | | 9/2019 |
| WO | 2013018740 | A1 | 2/2013 |
| WO | 2018168618 | A1 | 9/2018 |

OTHER PUBLICATIONS

Japanese Office Action—Japanese Application No. 2022-578877 issued on Jan. 23, 2024, citing JP 2010-059452, WO 2013/018740, WO 2018/168618, JP 2009-019258, JP 2008-255441, JP 2008-214645, and JP 2017-504716.

European Search Report—European Application No. 21825918.2 issued on Mar. 18, 2025, citing KR 10-2016-0078570, US 2014/0205855, US 2019/0337267, US 2018/0002771, and US 2017/0137906.

Chinese Decision to Grant—Chinese Application No. 202180043856.5 issued on Aug. 12, 2024, citing JP 2006-002186.

International Search Report - PCT/KR2021/007573 dated Sep. 27, 2021.

HIGH-STRENGTH STEEL SHEET HAVING EXCELLENT FORMABILITY AND METHOD FOR MANUFACTURING THEREOF

TECHNICAL FIELD

The present disclosure relates to steel suitable as a material for automobiles, and more particularly, to a high-strength steel sheet having excellent formability and a method for manufacturing the same.

BACKGROUND ART

Recently, the use of high-strength steel is required to improve fuel efficiency and durability due to various environmental regulations and energy use regulations.

In particular, as impact stability regulations of automobiles expand, high-strength steel having excellent strength is employed as a material for structural members such as members, seat rails, pillars, and the like, to improve impact resistance of vehicle bodies. These automobile parts have a complex shape according to safety and design, and are mainly manufactured by molding with a pressing mold, so high strength and high formability are required.

However, the higher the strength of steel, the more advantageous it is to absorb impact energy, but in general, when the strength increases, elongation decreases, so that there is a problem in that formability may be deteriorated. In addition, when yield strength is excessively high, there is a problem in that an inflow of the material from a mold is reduced during forming, so that formability may be deteriorated.

Meanwhile, high-strength steels used as automotive materials are typically dual phase steel (DP steel), transformation induced plasticity steel (TRIP steel), complex phase steel (CP steel), ferrite-bainite steel (FB steel), and the like.

DP steel, ultra-high tensile steel, has a low yield ratio of about 0.5 to 0.6, so there is an advantage in that it is easy to process and has the highest elongation after TRIP steel. Accordingly, it is mainly applied to door outers, seat rails, seat belts, suspensions, arms, wheel disks, and the like.

TRIP steel has excellent formability (high ductility) as it has a yield ratio in a range of 0.57 to 0.67, and is suitable for parts requiring high formability such as members, roofs, seat belts, bumper rails, and the like.

CP steel is applied to side panels and underbody reinforcing materials, or the like due to high elongation and bending workability as well as a low yield ratio, and FB steel is mainly applied to suspension lower arms, wheel disks, or the like due excellent hole expandability thereof.

Thereamong, DP steel is mainly composed of ferrite having excellent ductility and martensitic two-phase structure having high strength, and a trace amount of retained austenite may exist. DP steel has excellent characteristics such as low yield strength, high tensile strength, low yield ratio (YR), high work hardening rate, high ductility, continuous yield behavior, aging resistance at room temperature, and bake hardenability.

However, in order to secure ultra-high strength of 980 MPa or more of tensile strength, it is necessary to increase a fraction of a hard phase such as a martensite phase, which is advantageous for strength improvement. In this case, there is a problem in that the yield strength increases so that defects such as cracks occur during press forming.

In general, DP steel for automobiles manufactures slabs through steelmaking and casting processes, then [heating-rough rolling-finishing hot rolling] on the slabs to obtain hot-rolled coils and then annealing to prepare final products.

Here, the annealing process is a process of being mainly performed during manufacturing cold-rolled steel sheets. The cold-rolled steel sheets are manufactured by pickling the hot-rolled coil to remove surface scales, cold rolling the same at room temperature at a constant reduction rate, and then performing an annealing process and an additional temper rolling process if necessary.

The cold-rolled steel sheet (cold-rolled material) obtained by cold rolling itself is in a very hardened state and is not suitable for manufacturing parts requiring workability, so that the cold-rolled steel sheet may be softened through heat treatment in a continuous annealing furnace as s subsequent process, to improve workability.

For example, in the annealing process, a steel sheet (cold rolled material) is heated to approximately 650 to 850° C. in a heating furnace and maintained for a certain period of time, thereby reducing hardness and improving workability through recrystallization and phase transformation.

A steel sheet that has not been subjected to an annealing process has high hardness, particularly high surface hardness and poor workability, whereas a steel sheet subjected to an annealing process has a recrystallized structure and thus hardness, a yield point, and tensile strength are lowered, so that workability may be improved.

Meanwhile, as a representative method for lowering the yield strength of DP steel, it is advantageous to make a size of ferrite coarse during continuous annealing and to form austenite with a small size and uniformity.

As illustrated in FIG. 1, the continuous annealing process is performed through [heating section-soaking section-slow cooling section-rapid cooling section-over-aging section] in the annealing furnace. In this case, a fine ferrite phase is formed through sufficient recrystallization in the heating section, and then a small and uniform austenite phase is formed from the fine ferrite phase in the soaking section, and then the ferrite phase is recrystallized while forming fine bainite and martensite phases from the austenite during cooling.

As a prior art for improving workability of high-strength steel, Patent Document 1 discloses a method according to structural refinement, and specifically discloses a method in which finely precipitated copper particles having a particle diameter of 1 to 100 nm inside the structure for a composite steel sheet mainly having a martensite phase. However, this technology requires addition of 2 to 5% Cu in order to obtain good fine precipitated particles, so there is a concern that hot shortness caused by such a large amount of Cu may occur, and there is a problem in that a manufacturing cost is excessively increased.

Patent Document 2 discloses a high-strength steel sheet having a structure containing 2 to 10 area % of pearlite by using ferrite as a matrix structure, and resulting from precipitation strengthening and grain refinement through addition of carbon or nitride forming elements (e.g., Ti, etc.). In the case of this technology, although there is an advantage that high strength can be easily achieved compared to low manufacturing costs, it can be seen that since a recrystallization temperature is rapidly increased due to fine precipitation, heating to a fairly high temperature is required during continuous annealing to ensure high ductility by sufficient recrystallization. In addition, existing precipitation-reinforced steel, in which steel is strengthened by precipitating carbon nitride on a ferrite matrix, has a limit in obtaining high strength of 600 MPa or more.

Meanwhile, Patent Document 3 discloses a technology for securing a martensite volume ratio of 80 to 97% by continuously annealing a steel material containing 0.18% or more of carbon and water cooling the same to room temperature, and then performing an over-aging treatment for 1 to 15 minutes at a temperature of 120 to 300° C. While this technology is advantageous for improving yield strength, shape quality of a coil is deteriorated due to temperature deviation of the steel sheet in width and length directions during water cooling, so there are problems such as poor material depending on portions, deterioration of workability, and the like.

Judging from the above-described prior art, in order to improve the formability of high-strength steel, it required to develop a method capable of improving ductility while lowering the yield strength.

(Patent Document 1) Japanese Patent Application Laid-Open No. 2005-264176

(Patent Document 2) Korean Patent Publication No. 2015-0073844

(Patent Document 3) Japanese Patent Laid-Open No. 1992-289120

SUMMARY OF INVENTION

Technical Problem

An aspect of the present disclosure is to provide a high-strength steel sheet having high strength with a low yield ratio, and excellent formability through improvement of ductility, as a material, suitable for automobile structural members, etc., and a method for manufacturing the same.

The subject of the present disclosure is not limited to the above. The subject of the present disclosure will be understood from the overall content of the present specification, and those of ordinary skill in the art to which the present disclosure pertains will have no difficulty in understanding the additional subject of the present disclosure.

Solution to Problem

According to an aspect of the present disclosure, a high-strength steel sheet having excellent formability is provided, the steel sheet including, by weight %: 0.05 to 0.15% of carbon (C), 0.5% or less (excluding 0%) of silicon (Si), 2.0 to 3.0% of manganese (Mn), 0.2% or less (excluding 0%) of titanium (Ti), 0.1% or less (excluding 0%) of niobium (Nb), 0.2% or less (excluding 0%) of vanadium (V), 0.5% or less (excluding 0%) of molybdenum (Mo), 0.1% or less of phosphorus (P), 0.01% or less of sulfur (S), and a remainder of Fe and other unavoidable impurities, wherein a microstructure is composed of ferrite with an area fraction of 20 to 45%, and a remainder of martensite and bainite, and a fraction of non-recrystallized ferrite, among the ferrite, is 25 area % or less, and an average aspect ratio thereof (major axis:minor axis) is 1.1 to 2:1.

According to another aspect of the present disclosure, a method for manufacturing a high-strength steel sheet having excellent formability is provided, the method including: an operation of heating a steel slab having the alloy composition described above; an operation of manufacturing a hot-rolled steel sheet by finishing hot rolling the heated steel slab at an outlet temperature of Ar3 or higher and 1000° C. or lower; an operation of coiling the hot-rolled steel sheet in a temperature range of 400 to 700° C.; an operation of cooling the hot-rolled steel sheet to room temperature after the coiling operation; an operation of manufacturing a cold-rolled steel sheet by cold rolling at a reduction ratio of 40 to 70% after the cooling operation; an operation of continuous annealing of the cold-rolled steel sheet; an operation of primary cooling to a temperature range of 650 to 700° C. after the continuous annealing operation; and an operation of secondary cooling to a temperature range of 300 to 580° C. after the primary cooling operation, wherein the continuous annealing operation is performed in a facility equipped with a heating section, a soaking section, and a cooling section, and an end temperature in the heating section is higher than an end temperature in the soaking section by 10° C. or higher.

Advantageous Effects of Invention

As set forth, according to the present disclosure, a steel sheet having improved formability through securing a low yield ratio and high ductility even having high strength may be provided.

As described above, since the steel sheet of the present disclosure having improved formability may prevent processing defects such as cracks, wrinkles, or the like, during press forming, it has an effect of being suitably applied to parts for structures requiring processing into complex shapes.

BEST MODE FOR INVENTION

Figure 1:
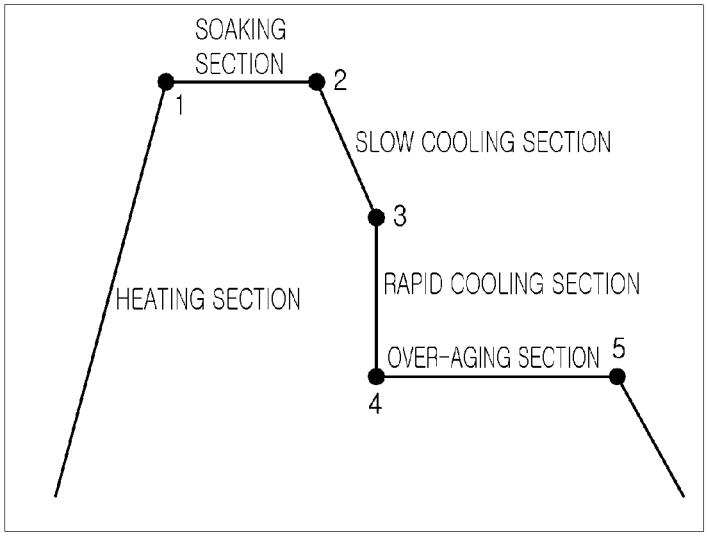
FIG. 1 is a schematic diagram of a heat treatment diagram of a conventional continuous annealing process (CAL)
Figure 2:
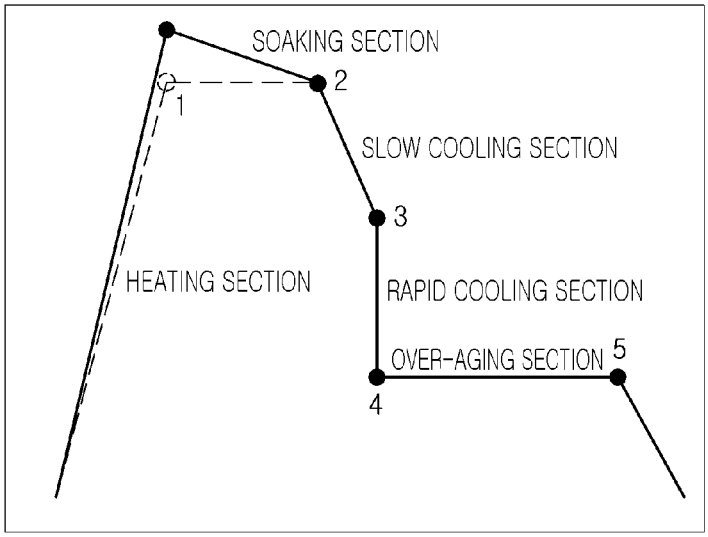
FIG. 2 is a schematic diagram of a heat treatment diagram of a continuous annealing process (CAL) according to an aspect of the present disclosure, and is illustrated together with the diagram (gray line) of FIG. 1.

The present inventors have studied in detail in order to develop a material having a level of formability, suitable for use in parts requiring processing into complex shapes among materials for automobiles.

In particular, the present inventors have confirmed that the target can be achieved by inducing sufficient recrystallization of a soft phase affecting ductility of steel, and uniformly securing refinement and distribution of a hard phase, advantageous for securing strength, thereby resulting in completion of the present disclosure.

Hereinafter, the present disclosure will be described in detail.

According to an aspect of the present disclosure, a high-strength steel sheet having excellent formability may include, by weight %: 0.05 to 0.15% of carbon (C), 0.5% or less (excluding 0%) of silicon (Si), 2.0 to 3.0% of manganese (Mn), 0.2% or less (excluding 0%) of titanium (Ti), 0.1% or less (excluding 0%) of niobium (Nb), 0.2% or less (excluding 0%) of vanadium (V), 0.5% or less (excluding 0%) of molybdenum (Mo), 0.1% or less of phosphorus (P), and 0.01% or less of sulfur (S).

Hereinafter, a reason for limiting an alloy composition of the steel material for a pressure vessel provided in the present disclosure as above will be described in detail.

Meanwhile, unless otherwise specified in the present disclosure, the content of each element is based on a weight, and a ratio of a microstructure is based on an area.

Carbon (C): 0.05 to 0.15%

Carbon (C) is an important element added for solid solution strengthening, and C combines with the precipitating elements to form fine precipitates, thereby contributing to improving strength of steel.

When a content of C exceeds 0.15%, hardenability increases and as martensite is formed during cooling during steel manufacturing, there is a problem in that the strength is excessively increased while the elongation is decreased. In addition, there is a concern that welding defects may occur during processing into parts due to poor weldability. Meanwhile, when the content of C is less than 0.05%, it becomes difficult to secure a target level of strength.

Accordingly, C may be included in an amount of 0.05 to 0.15%. More advantageously, C may be included in an amount of 0.06% or more, and may be included in an amount of 0.13% or less.

Silicon (Si): 0.5% or Less (Excluding 0%)

Silicon (Si) is a ferrite stabilizing element, and is advantageous in securing a target level of ferrite fraction by promoting ferrite transformation. In addition, Si is an element effective for increasing the strength of ferrite due to its good solid solution strengthening ability, and effective for securing strength without reducing ductility of steel.

When a content of Si exceeds 0.5%, a solid solution strengthening effect is excessive and the ductility is rather deteriorated, and surface scale defects are caused, which adversely affects the plating surface quality. In addition, there is a problem in the process of chemical conversion coating.

Accordingly, Si may be included in an amount of 0.5% or less, and 0% may be excluded. More advantageously, Si may be included in an amount of 0.1% or more.

Manganese (Mn): 2.0 to 3.0%

Manganese (Mn) is an element that prevents hot brittleness caused by the generation of FeS by precipitating sulfur (S) in steel as MnS, and is advantageous for solid solution strengthening of steel.

When a content of Mn is less than 2.0%, the above-described effect cannot be obtained, and it is difficult to secure a target level of strength. On the other hand, when the content of Mn exceeds 3.0%, there is a high possibility that problems such as weldability, hot-rollability, and the like occur, and at the same time, there is a concern that ductility may be lowered as martensite is more easily formed due to an increase in hardenability. In addition, there is a problem in that a risk of occurrence of defects such as processing cracks increases due to excessive formation of Mn-Bands (Mn oxide bands) in the structure. There is a problem in that a Mn oxide is eluted on a surface thereof during annealing, which greatly impairs plating property.

Accordingly, Mn may be included in an amount of 2.0 to 3.0%, and more advantageously, Mn may be included in an amount of 2.2 to 2.8%.

Titanium (Ti): 0.2% or Less (Excluding 0%)

Titanium (Ti) is an element forming fine carbides and contributing to securing yield strength and tensile strength. In addition, Ti has an effect of suppressing the formation of AlN by Al inevitably present in steel by precipitating N as TiN in the steel, thereby reducing a possibility of occurrence of cracks during continuous casting.

When a content of Ti exceeds 0.2%, coarse carbides are precipitated, and there is a concern that a decrease in strength and elongation due to a reduction in an amount of carbon in the steel. In addition, there is a concern that nozzle clogging is caused during continuous casting. Accordingly, Ti may be included in 0.2% or less, and 0% may be excluded.

Niobium (Nb): 0.1% or Less (Excluding 0%)

Niobium (Nb) is an element that segregates at an austenite grain boundary, suppresses coarsening of austenite grains during annealing heat treatment, and forms fine carbides to contribute improving strength.

When a content of Nb exceeds 0.1%, coarse carbides are precipitated, and strength and elongation may be deteriorated due to a reduction in the amount of carbon in the steel, and there is a problem in that manufacturing costs increase. Accordingly, Nb may be included in an amount of 0.1% or less, and 0% may be excluded.

Vanadium (V): 0.2% or Less (0% or Less)

Vanadium (V) is an element that reacts with carbon or nitrogen to form carbides or nitrides, and is an important element in improving yield strength of steel by forming fine precipitates at a low temperature.

When a content of V exceeds 0.2%, coarse carbides are precipitated, and strength and elongation may be deteriorated due to a reduction in the amount of carbon in the steel, and there is a problem in that manufacturing costs increase. Accordingly, V may be included in 0.2% or less, and 0% may be excluded.

Molybdenum (Mo): 0.5% or Less (Excluding 0%)

Molybdenum (Mo) is an element that forms carbides in steel, and is advantageous for improving yield strength and tensile strength of steel by maintaining a fine size of precipitates upon compound addition with carbide or nitride forming elements such as Ti, Nb, V, or the like, as described above. In addition, Mo delays transformation of austenite into pearlite, and at the same time has an effect of refining ferrite and improving strength. Such Mo has an advantage that a yield ratio can be controlled by finely forming martensite at grain boundaries by improving the hardenability of steel. However, as an expensive element, the higher the content thereof, the higher the manufacturing cost increases, thereby becoming economically disadvantageous. Therefore, it is preferable to appropriately control the content thereof.

In order to sufficiently obtain the above-described effect, Mo may be added at a maximum of 0.5%. When the content of Mo exceeds 0.5%, it causes a rapid increase in an alloy cost, resulting in poor economic feasibility, and there is a problem in that the ductility of steel is rather reduced due to the excessive grain refinement effect and the solid solution strengthening effect.

Accordingly, Mo may be included in an amount of 0.5% or less, and 0% may be excluded.

Phosphorus (P): 0.1% or Less

Phosphorus (P) is a substitutional element having the greatest solid solution strengthening effect, and is an element advantageous in securing strength while improving in-plane anisotropy and not significantly lowering formability. However, when an excessive amount of P is added, a possibility of occurrence of brittle fracture is greatly increased, so that a possibility of occurrence of plate fracture of a slab during hot rolling increases, and there is a problem of impairing the plating surface properties.

Accordingly, in the present disclosure, the content of P may be controlled to 0.1% or less, and 0% may be excluded in consideration of the unavoidably added level.

Sulfur (S): 0.01% or Less

Sulfur (S) is also an element that is inevitably added as an impurity element in steel, and since S inhibits ductility, so it is desirable to manage a content of S as low as possible. In particular, since S has a problem of increasing a possibility of generating hot shortness, it is preferable to control the content thereof to 0.01% or less. However, 0% may be excluded in consideration of the unavoidably added level during the manufacturing process.

A remainder of the present disclosure may be iron (Fe). However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure.

The steel sheet of the present disclosure having the above-described alloy composition is composed of ferrite as a microstructure, and martensite and bainite phases, which are hard phases, wherein the ferrite is included in an area fraction of 20 to 45%, and a remainder thereof may be a hard phase.

When the fraction of the ferrite phase is less than 20%, the ductility of steel cannot be sufficiently secured so that formability is deteriorated. On the other hand, when the fraction thereof exceeds 45%, a fraction of the hard phase is relatively low, so that it is impossible to secure a target level of strength and formability.

In the steel sheet of the present disclosure including a ferrite phase in the above-described fraction range, non-recrystallized ferrite in the ferrite is present in a fraction of 25 area % or less, and it is preferable that an average aspect ratio is 1.1 to 2:1.

When the fraction of the non-recrystallized ferrite exceeds 25 by area %, ductility is lowered so that it is difficult to secure a target level of formability.

Meanwhile, even if the fraction of non-recrystallized ferrite is in 25 area % or less, when the average aspect ratio exceeds 2 (major axis:minor axis=more than 2:1), deformation and stress are locally concentrated in the stretched non-recrystallized ferrite as described above, so there is a problem that the ductility becomes be deteriorated. A lower limit of the average aspect ratio of the non-recrystallized ferrite does not need to be particularly limited, but in consideration of the shape of the non-recrystallized ferrite by processing, the lower limit of the average aspect ratio may be set to 1.1 or more.

It should be noted that the fraction of non-recrystallized ferrite is shown based on the ferrite fraction described above, not based on an overall microstructure fraction of the steel sheet.

Figure 5:
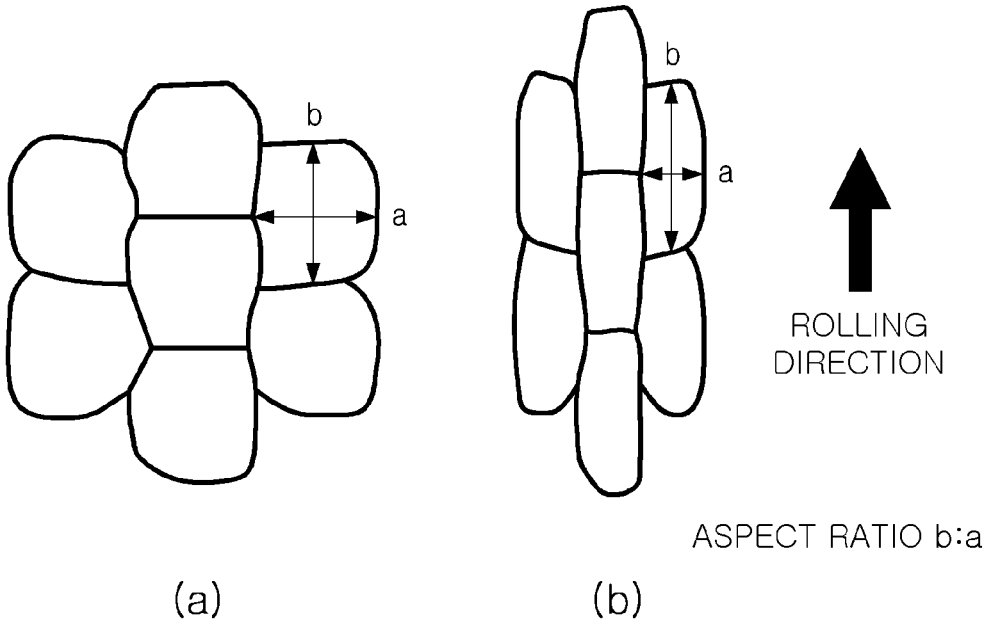
FIG. 5 is a schematic diagram illustrating an aspect ratio of ferrite grains in an embodiment of the present disclosure.

Here, the aspect ratio means a ratio (major axis:minor axis) of a length (major axis) to a width (minor axis) of a grain size with respect to a rolling direction, for example, as shown in FIG. 5. In FIG. 5, (a) is a schematic diagram illustrating a grain size of recrystallized ferrite, (b) is a schematic diagram illustrating a grain size of non-recrystallized ferrite. In addition, in the present disclosure, the aspect ratio value means a value of an average aspect ratio of non-recrystallized ferrite grains.

Meanwhile, the martensite and bainite phases constituting the hard are not specifically limited for each fraction, but in order to secure ultra-high strength with a tensile strength of 980 MPa or more, a martensite phase may be included in 10 area % or less (excluding 0%) of the overall structural fraction.

The steel sheet of the present disclosure having the above-mentioned microstructure has a tensile strength of 980 MPa or more, a yield strength of 680 MPa or less, an elongation (total elongation) of 13% or more, and may have properties of high ductility and low resistance ratio as well as high strength with a yield ratio of 0.8 or less.

Hereinafter, a method for manufacturing a high-strength steel sheet having excellent formability according to another aspect of the present disclosure will be described in detail.

Briefly, in the present disclosure, a desired steel sheet through process of [heating steel slab-hot rolling-coiling-cold rolling-continuous annealing], and each process will be described in detail below.

[Heating Steel Slab]

First, after preparing a steel slab satisfying the above-described alloy composition, the steel slab can be heated.

This process is performed in order to smoothly perform a subsequent hot rolling process and sufficiently obtain target physical properties of the steel sheet. In the present disclosure, there is no particular limitation on conditions of the heating process, and any normal conditions may be used. As an example, the heating process may be performed in a temperature range of 1100 to 1300° C.

[Hot-Rolling]

The steel slab heated according to the above may be hot-rolled to be manufactured as a hot-rolled steel sheet, and in this case, finishing hot rolling may be performed at an outlet temperature of Ar3 or higher and 1000° C. or lower.

When the outlet temperature during the finishing hot rolling is less than Ar3, hot deformation resistance increases rapidly, a top portion, a tail portion, and an edge portion of a hot-rolled coil are single-phase regions, which increases in-plane anisotropy, which may deteriorate formability. Meanwhile, when the temperature exceeds 1000° C., a rolling load is relatively reduced, which is advantageous for productivity, but there is a concern that a thick oxide scale may occur.

More specifically, the finishing hot rolling may be performed in a temperature range of 760 to 940° C.

[Coiling]

The hot-rolled steel sheet manufactured according to the above may be wound in a coil shape.

The coiling operation may be performed in a temperature range of 400 to 700° C. If a coiling temperature is less than 400° C., an excessive increase in strength of the hot-rolled steel sheet due to excessive formation of martensite or bainite may cause problems such as shape defects due to load during subsequent cold rolling. On the other hand, when the coiling temperature exceeds 700° C., there is a problem that a surface scale increases and a pickling property deteriorates.

[Cooling]

It is preferable to cool the wound hot-rolled steel sheet to room temperature at an average cooling rate of 0.1° C./s or less (excluding 0° C./s) to room temperature. In this case, the wound hot-rolled steel sheet may be cooled after performing processes such as transport, stacking, and the like, and the process before cooling is not limited thereto.

As described above, by cooling the wound hot-rolled steel sheet at a constant rate, it is possible to obtain a hot-rolled steel sheet in which carbides serving as nucleation sites of austenite are finely dispersed.

[Cold-Rolling]

The hot-rolled steel sheet wound according to the above may be cold-rolled to be manufactured as a cold-rolled steel sheet.

In this case, the cold rolling operation may be performed at a cold rolling reduction of 40 to 70%. If the cold reduction is less than 40%, it is difficult to obtain good recrystallization grains because recrystallization driving force is weakened. On the other hand, when the cold rolling reduction exceeds 70%, there is a high possibility that cracks are generated in an edge portion of the steel sheet, and there is a concern that a rolling load is rapidly increased.

According to the present disclosure, a hot-rolled steel sheet may be pickled before the cold rolling, and it should be noted that the pickling process may be performed in a conventional manner.

[Continuous Annealing]

It is preferable to continuously anneal the cold-rolled steel sheet manufactured according to the above. The continuous annealing treatment may be performed, for example, in a continuous annealing furnace (CAL).

Normally, the continuous annealing furnace (CAL) is composed of [heating section-soaking section-cooling section (slow cooling section and rapid cooling section)-overaging section], and after the cold-rolled steel sheet is charged into the continuous annealing furnace, it is heated to a specific temperature in the heating section, and after reaching a target temperature, it is maintained in the soaking section for a period of time.

In the present disclosure, it was intended to establish a method to apply sufficient heat input to the steel sheet in the heating section consisting of [heating section-soaking section] during continuous annealing, in order to obtain fine martensite and bainite phases as well as ferrite recrystallized into a final microstructure.

Specifically, in a general continuous annealing process, a final temperature in the heating section is controlled to be equal to the temperature in the soaking section. On the other hand, in the present disclosure, the temperatures in the heating section and the soaking section are controlled independently.

In other words, in the general continuous annealing process, a start temperature and an end temperature in the soaking section are controlled equally, which means that an end temperature in the heating section and a start temperature in the soaking section are the same.

On the other hand, in the present disclosure, by controlling the temperature of the heating section to be higher than the temperature of the soaking section, recrystallization of ferrite can be further promoted in the heating section, thereby induced to form fine ferrite, and austenite formed at the ferrite grain boundary is also formed to be small and uniform.

Preferably, in the present disclosure, the end temperature in the heating section may be controlled to be 10° C. or more higher than the end temperature in the soaking section, and more preferably, the following relational expression may be satisfied, $$10 \leq \text{End temperature in heating section} - \text{End temperature in soaking section } (^\circ\text{C.}) \leq 40 \quad \text{[Relational Expression]}$$

That is, in the present disclosure, the end temperature in the heating section is controlled to be higher than the end temperature in the soaking section. When a temperature difference therebetween is less than 10° C., ferrite recrystallization is delayed, so that it is difficult to obtain a fine and uniform austenite phase, On the other hand, when the temperature difference therebetween exceeds 40° C., a subsequent cooling process may not be sufficiently performed due to an excessive temperature difference, and there is a concern that a coarse martensite or coarse bainite phase may be formed in a final structure.

In the present disclosure, the end temperature in the heating section may be 790 to 830° C. When the temperature is less than 790° C., sufficient heat input for recrystallization cannot be applied. On the other hand, when the temperature exceeds 830° C., productivity is lowered and the austenite phase is excessively formed, and a fraction of a hard phase after the subsequent cooling process, so there is a concern that the ductility of the steel may be deteriorated.

In addition, the end temperature in the soaking section may be 760 to 790° C., when the temperature is less than 760° C., it is economically disadvantageous because excessive cooling is required at the end temperature in the heating section, and an amount of heat for recrystallization may not be sufficient. On the other hand, when the temperature exceeds 790° C., a fraction of austenite becomes excessive, and a fraction of a hard phase is exceeded during cooling, and there is a concern that the formability is reduced.

Meanwhile, in the present disclosure, the temperature difference between the end temperature in the heating section and the end temperature om the soaking section can be implemented by blocking a heating means from the time when a process in the heating section is completed to the time when a process in the soaking section is completed, and as an example, it may be furnace-cooled in the corresponding section.

[Stepwise Cooling]

By cooling the continuous annealed cold-rolled steel sheet according to the above, a target structure may be formed, and in this case, it is preferable to perform cooling stepwise.

In the present disclosure, the stepwise cooling may consist of primary cooling-secondary cooling, specifically, after the continuous annealing, after performing primary cooling at an average cooling rate of 1 to 10° C./s to a temperature range of 650 to 700° C., secondary cooling may be performed at an average cooling rate of 5 to 50° C./s up to a temperature range of −580° C.

In this case, by performing the primary cooling operation more slowly compared to the secondary cooling, it is possible to suppress plate shape defects due to a rapid decrease in temperature during secondary cooling, which is a relatively rapid cooling section thereafter.

If an end temperature during the primary cooling is less than 650° C., a carbon concentration in ferrite is high due to low diffusion activity of carbon due to too low temperature, whereas as the carbon concentration in austenite is lowered, a fraction of a hard phase is excessive and a yield ratio is increased, thereby increasing a tendency of occurring cracks during processing. In addition, a cooling rate in the crack section and the slow cooling section is too large, which causes a problem that the shape of the plate becomes non-uniform.

When the end temperature exceeds 700° C., there is a disadvantage in that an excessively high cooling rate is required for subsequent cooling (secondary cooling). In addition, when the average cooling rate during the primary cooling exceeds 10° C./s, carbon diffusion cannot sufficiently occur. Meanwhile, in consideration of productivity, the primary cooling process may be performed at an average cooling rate of 1° C./s or more.

As mentioned above, after completing the above-described primary cooling, rapid cooling may be performed at a cooling rate of a predetermined or higher. In this case, when a secondary cooling end temperature is less than 300° C., there is a concern that cooling deviation occurs in width and length directions of the steel sheet and the plate shape is deteriorated. On the other hand, when the temperature exceeds 580° C., a hard phase may not be sufficiently secured so that the strength may be lowered. In addition, when an average cooling rate during the secondary cooling is less than 5° C./s, there is a concern that a fraction of a hard phase may be excessive. On the other hand, when average cooling rate during the secondary cooling exceeds 50° C./s, there is a concern that the hard phase is rather insufficient.

Meanwhile, if necessary, after the stepwise cooling is completed, over-aging treatment may be performed.

The over-aging treatment is a process of maintaining a predetermined time after the secondary cooling is completed, and has an effect of improving shape quality by uniform heat treatment in width and length directions of the coil. To this end, the over-aging treatment may be performed for 200 to 800 seconds.

The over-aging treatment has a temperature lower than the secondary cooling end temperature, and as a non-limiting example, it should be noted that it can be performed in a temperature range of 280 to 400° C.

The high-strength steel sheet of the present disclosure manufactured as described above has a microstructure and consists of a hard phase and a soft phase, and in particular, by maximizing ferrite recrystallization by an optimized annealing process, the high-strength steel sheet may have, a structure in which bainite and martensite, which are hard phases, are uniformly distributed in the finally recrystallized ferrite matrix.

From this, although the steel sheet of the present disclosure has a high tensile strength of 980 MPa or more, excellent formability can be ensured by ensuring a low resistance yield ratio and high ductility Hereinafter, the present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

MODE FOR INVENTION

Example

Hereinafter, after preparing a steel slab having an alloy composition shown in Table 1 below, each steel slab was heated at 1200° C. for 1 hour, and then finishing hot-rolled at a finishing rolling temperature of 880 to 920° C. to prepare a hot-rolled steel sheet. Thereafter, each the hot-rolled steel sheet was cooled at a cooling rate of 0.1° C./s and wound at 650° C. Thereafter, the wound hot-rolled steel sheet was cold-rolled at a reduction ratio of 50% to prepare a cold-rolled steel sheet. Each of the cold-rolled s eel sheets was subjected to continuous annealing under the tempera Lure conditions shown in Table 2 below, and then over-aged at 360° C. for 520 seconds after stepwise cooling operation (primary-secondary), to prepare a final steel sheet.

In this case, during the stepwise cooling operation, primary cooling was performed at an average cooling rate of 3° C./s, and secondary cooling was performed at an average cooling rate of 20° C./s.

After observing a microstructure for each of the steel sheets prepared according to the above, and evaluating mechanical properties and plating properties, the results thereof were shown in Table 3 below.

In this case, for a tensile test for each test specimen, a tensile test specimen of JIS No. 5 size was taken in a vertical direction of a rolling direction, and then a tensile test was performed at a strain rate of 0.01/s.

Non-recrystallized ferrite in a structural phase was observed through SEM at 5000 magnification after nital etching. In this case, from a crystal grain shape of the observed ferrite phase, sub-grains observed in normal non-recrystallized ferrite or particles elongated in a rolling direction were analyzed as non-recrystallized ferrite, and a fraction thereof was measured. For other phases, each fraction was measured using SEM and an image analyzer after nital etching.

TABLE 1

| Steel | Alloy composition (by weight %) | | | | | | | | |
|---|---|---|---|---|---|---|---|---|---|
| No. | C | Si | Mn | P | S | Ti | Nb | V | Mo |
| 1 | 0.06 | 0.2 | 2.3 | 0.011 | 0.0051 | 0.02 | 0.005 | 0.1 | 0.2 |
| 2 | 0.07 | 0.3 | 2.7 | 0.012 | 0.0045 | 0.04 | 0.007 | 0.08 | 0.3 |

TABLE 2

| | Continuous annealing conditions (° C.) | | | | | |
|---|---|---|---|---|---|---|
| Steel No. | End temperature in heating section | End temperature in crack section | Temperature difference | Primary cooling end temperature | Secondary cooling end temperature | Classification |
| 1 | 750 | 750 | 0 | 650 | 450 | Comparative Example 1 |
| 1 | 770 | 770 | 0 | 650 | 450 | Comparative Example 2 |
| 1 | 790 | 790 | 0 | 650 | 450 | Comparative Example 3 |
| 2 | 790 | 790 | 0 | 650 | 450 | Comparative Example 4 |
| 2 | 800 | 790 | 10 | 650 | 450 | Inventive Example 1 |
| 2 | 810 | 790 | 20 | 650 | 450 | Inventive Example 2 |
| 2 | 800 | 790 | 10 | 650 | 450 | Inventive Example 3 |
| 2 | 810 | 790 | 20 | 650 | 450 | Inventive Example 4 |

TABLE 2-continued

| Steel No. | Continuous annealing conditions (° C.) End temperature in heating section | End temperature in crack section | Temperature difference | Primary cooling end temperature | Secondary cooling end temperature | Classification |
|---|---|---|---|---|---|---|
| 2 | 830 | 790 | 40 | 650 | 450 | Inventive Example 5 |
| 1 | 850 | 790 | 60 | 650 | 450 | Comparative Example 5 |
| 1 | 790 | 750 | 40 | 650 | 450 | Comparative Example 6 |
| 1 | 790 | 770 | 20 | 650 | 450 | Inventive Example 6 |
| 2 | 790 | 770 | 20 | 650 | 450 | Inventive Example 7 |
| 2 | 790 | 810 | 20 | 650 | 450 | Comparative Example 7 |
| 2 | 750 | 750 | 0 | 650 | 450 | Comparative Example 8 |
| 2 | 770 | 770 | 0 | 650 | 450 | Comparative Example 9 |
| 2 | 840 | 840 | 0 | 650 | 450 | Comparative Example 10 |

TABLE 3

| Classification | Microstructure F[1] (in area % ) | Non-recrystallization F[2] Fraction (in area %) | Non-recrystallization F[2] Aspect ratio[3] | Mechanical property YS (MPa) | TS (MPa) | Yield ratio (YS/TS) | Total elongation (%) |
|---|---|---|---|---|---|---|---|
| Comparative Example 1 | 55 | 32 | 3.2:1 | 478.9 | 929.6 | 0.52 | 6.2 |
| Comparative Example 2 | 50 | 30 | 3.1:1 | 623.8 | 1090.3 | 0.57 | 11.2 |
| Comparative Example 3 | 40 | 23 | 2.4:1 | 691.4 | 1106.6 | 0.62 | 13.5 |
| Comparative Example 4 | 45 | 24 | 2.1:1 | 693.4 | 1108.5 | 0.63 | 13.2 |
| Inventive Example 1 | 35 | 13 | 1.1:1 | 650.6 | 1077.3 | 0.63 | 13.6 |
| Inventive Example 2 | 33 | 11 | 1.2:1 | 648.4 | 1072.7 | 0.60 | 13.9 |
| Inventive Example 3 | 34.5 | 13 | 1.2:1 | 651.8 | 1080.1 | 0.60 | 13.6 |
| Inventive Example 4 | 33 | 11 | 1.3:1 | 648.5 | 1062.8 | 0.61 | 13.8 |
| Inventive Example 5 | 31 | 2 | 1.2:1 | 628.2 | 1043.1 | 0.60 | 14.5 |
| Comparative Example 5 | 10 | 0 | — | 700.4 | 1055.3 | 0.66 | 10.4 |
| Comparative Example 6 | 55 | 18 | 3.1:1 | 655.9 | 1095.6 | 0.60 | 12.7 |
| Inventive Example 6 | 43 | 18 | 1.2:1 | 670.1 | 1096.2 | 0.61 | 13.8 |
| Inventive Example 7 | 41 | 18 | 1.6:1 | 677.0 | 1106.2 | 0.61 | 13.3 |
| Comparative Example 7 | 47 | 0 | — | 680.3 | 1069.2 | 0.64 | 12.7 |
| Comparative Example 8 | 52 | 32 | 3.4:1 | 478.9 | 929.6 | 0.52 | 6.2 |
| Comparative Example 9 | 48 | 30 | 3.2:1 | 623.8 | 1090.3 | 0.57 | 11.2 |
| Comparative Example 10 | 10 | 0 | — | 692.6 | 1054.5 | 0.66 | 11.8 |

[1]It represents a ferrite phase, and is a fraction of a total ferrite phases.

[2]It represents a fraction of non-recrystallized ferrite phases among a total ferrite phases.

[3]It represents an average aspect ratio (major axis:minor axis) of the non-recrystallized ferrite phase.

In all examples, except for the fraction of ferrite (F), a remaining structure is composed of a hard phase (bainite and martensite).

As illustrated in Tables 1 to 3, in Inventive Examples 1 to 7, in which a steel alloy composition and manufacturing conditions, particularly, a continuous annealing process satisfies all of the suggestions in the present disclosure, it can be confirmed that, as the intended microstructure is formed, formability may be secured since elongation is excellent while having high strength.

On the other hand, in Comparative Examples 1 to 4 and Comparative Examples 8 to 10, in which the continuous annealing process of the steel sheet manufacturing process was applied the same as before, that is, an end temperature in a heating section and an end temperature in a soaking section were applied the same, ferrite recrystallization during annealing was insufficient, so that the target properties in the present disclosure were not satisfied. Thereamong, in Comparative Examples 1 and 2 and Comparative Examples 8 and 9, which had a relatively low annealing temperature, elongation was deteriorated, and in Comparative Examples 3 and 4 and Comparative Example 10, which had a relatively high annealing temperature, a yield strength exceeded a target level.

In Comparative Example 5, in which a temperature difference between the end temperature in the crack section and the end temperature in the heating section was 60° C., since the end temperature in the heating section was excessively high, during continuous annealing during the manufacturing process of the steel sheet, a ferrite phase was not sufficiently formed, but a hard phase (especially, a bainite phase) was excessively formed, resulting in a decrease in elongation.

In Comparative Example 6, in which the end temperature in the crack section was too low, although the temperature difference between the end temperature in the heating section and the end temperature in the crack section was 20° C., elongation was also deteriorated.

Comparative Example 7 illustrates a case in which a temperature in a crack section was rather increased compared to a temperature in a heating section, and in this case, high ductility could not be secured.

Figure 3:
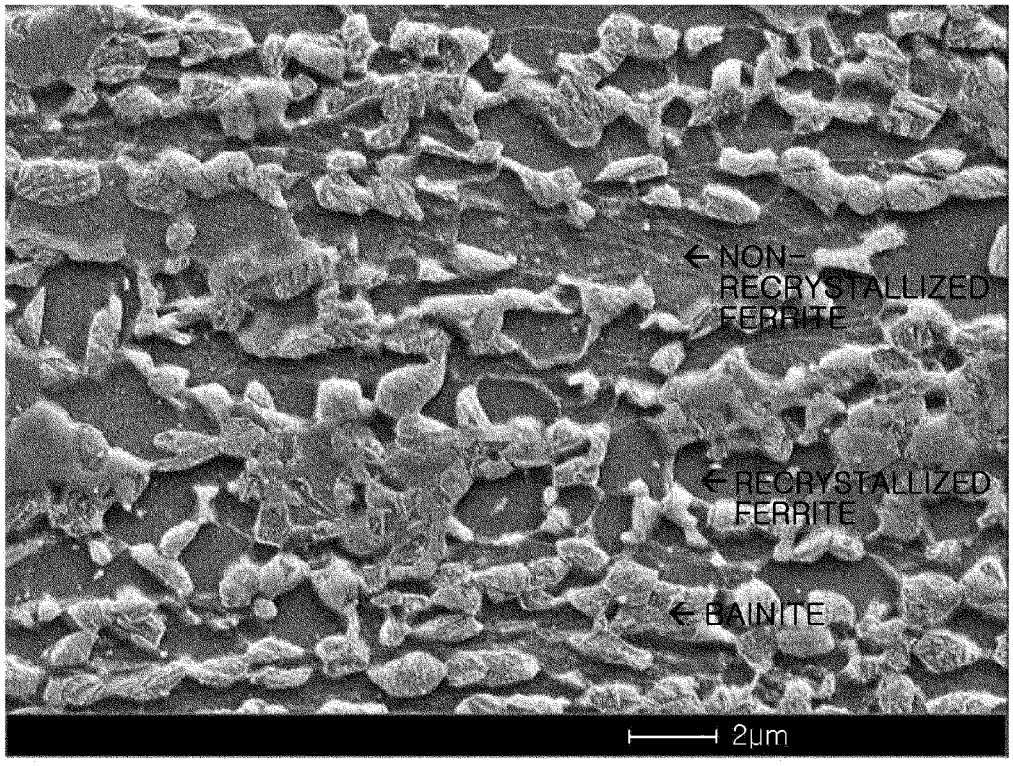
FIG. 3 illustrates a microstructure photograph of a comparative example according to an embodiment of the present disclosure.
Figure 4:
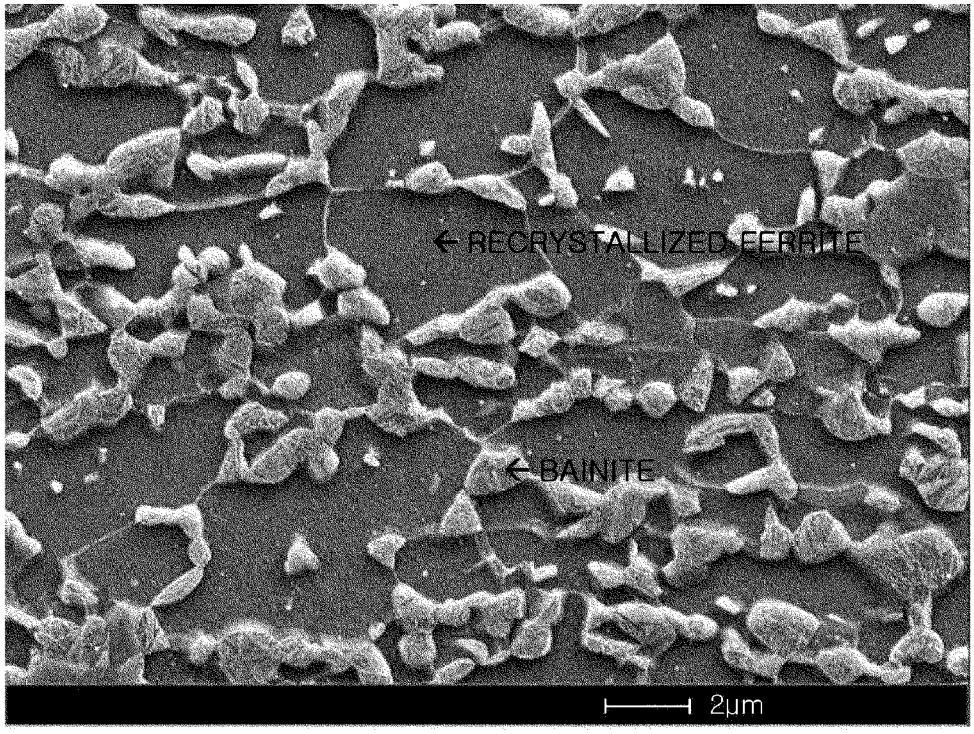
FIG. 4 illustrates a microstructure photograph of the inventive example according to an embodiment of the present disclosure.

FIG. 3 illustrates a photograph of the microstructure or Comparative Example 2, and FIG. 4 illustrates a photograph of the microstructure of Inventive Example 2.

In Comparative Example 2, it can be confirmed that a non-recrystallized ferrite phase is excessively formed, whereas in Inventive Example 2, it can be confirmed that a marten site phase and a bainite phase are formed in a recrystallized ferrite matrix having a relatively sufficient fraction.

While example embodiments have been shown and described above, it will be apparent to those skilled in the art that modifications and variations could be made without departing from the scope of the present disclosure as defined by the appended claims.

The invention claimed is:

1. A steel sheet comprising, by weight %:

0.05 to 0.15% of carbon (C), 0.5% or less (excluding 0%) of silicon (Si), 2.0 to 3.0% of manganese (Mn), 0.2% or less (excluding 0%) of titanium (Ti), 0.1% or less (excluding 0%) of niobium (Nb), 0.2% or less (excluding 0%) of vanadium (V), 0.5% or less (excluding 0%) of molybdenum (Mo), 0.1% or less of phosphorus (P), 0.01% or less of sulfur (S), and a remainder of Fe and unavoidable impurities, wherein a microstructure is composed of ferrite with an area fraction of 20 to 45%, and a remainder of martensite and bainite, and a fraction of non-recrystallized ferrite, among the ferrite is 25 area % or less, and an average aspect ratio thereof (major axis:minor axis) is 1.1 to 2:1.

2. The steel sheet of claim 1, wherein the martensite is contained in an area fraction of 10% or less (excluding 0%).

3. The steel sheet of claim 1, wherein the steel sheet has a tensile strength of 980 MPa or more, a yield strength of 680 MPa or less, and an elongation of 13% or more.

4. The steel sheet of claim 1, wherein the steel sheet has a yield ratio of 0.8 or less.

* * * * *